US008929571B2

(12) United States Patent
Reverchon et al.

(10) Patent No.: US 8,929,571 B2
(45) Date of Patent: Jan. 6, 2015

(54) METHOD FOR CREATING AN AUDIO ENVIRONMENT HAVING N SPEAKERS

(75) Inventors: Michel Reverchon, Nice (FR); Véronique Adam, Geneva (CH)

(73) Assignee: Goldmund Monaco Sam, Monaco (MC)

( * ) Notice: Subject to any disclaimer, the term of this patent is extended or adjusted under 35 U.S.C. 154(b) by 344 days.

(21) Appl. No.: 13/518,524

(22) PCT Filed: Jan. 26, 2011

(86) PCT No.: PCT/EP2011/051089

§ 371 (c)(1),
(2), (4) Date: Aug. 28, 2012

(87) PCT Pub. No.: WO2011/095422

PCT Pub. Date: Aug. 11, 2011

(65) Prior Publication Data

US 2013/0003999 A1 Jan. 3, 2013

(30) Foreign Application Priority Data

Feb. 4, 2010 (FR) ..... 10 50795

(51) Int. Cl.
*H04R 5/02* (2006.01)
*H04S 3/00* (2006.01)
*H04S 7/00* (2006.01)

(52) U.S. Cl.
CPC ... *H04S 3/00* (2013.01); *H04S 7/30* (2013.01); *H04R 2205/024* (2013.01)
USPC ..... 381/307; 381/66; 381/123; 700/94

(58) Field of Classification Search
None
See application file for complete search history.

(56) References Cited

U.S. PATENT DOCUMENTS 4,524,451 A * 6/1985 Watanabe ..... 381/1
5,594,800 A 1/1997 Gerzon (Continued)

FOREIGN PATENT DOCUMENTS

| | | |
|---|---|---|
| EP | 2093585 | 7/2009 |
| FR | 2922404 | 4/2009 |
| WO | 2007/083739 | 7/2007 |

OTHER PUBLICATIONS

Edwin Nico Gerard Verheijen, Sound Reproduction by Wave Field Synthesis, Jan. 19, 1998, 1-190 pages.*
International search report dated Mar. 29, 2011 in corresponding PCT/EP2011/051089.

(Continued)

*Primary Examiner* — Duc Nguyen
*Assistant Examiner* — Assad Mohammed
(74) *Attorney, Agent, or Firm* — Young & Thompson

(57) ABSTRACT

Method for creating an audio environment having N speakers $HP_{i,\ i=1\ldots N}$ fed by N signals $S_{i,\ i=1\ldots N}$ generated from M theoretical signals $ST_{j,\ j=1\ldots M}$ provided to feed M theoretical speakers $HPT_{j,\ j=1\ldots M}$, wherein:

position information is determined relating to the N speakers $HP_{i,\ i=1\ldots N}$ and a listening point, the two theoretical speakers $HPT_j$ and $HPT_{j+1}$ which would be angularly closest to a speaker $HP_i$, the signal Si is determined according to the following equation:

$$S_i=G_i[ST_j(Gp_{ij}Ge_{ij})+ST_{j+1}(Gp_{i(j+1)}Ge_{i(j+1)})]e^{-i\omega\tau_i}$$

wherein:

$Gp_{ij}$ and $Gp_{i(j+1)}$ are panning gains, $Ge_{ij}$ and $Ge_{i(j+1)}$ are balancing gains $G_i$ and $_i$ are a positioning gain and delay, respectively, which enable the speakers $HP_{i,\ i=1\ldots N}$ to be virtually repositioned in terms of distance so that all sounds intended to simultaneously arrive at the listening point according to the encoding format actually arrive therein simultaneously, irrespective of the remoteness of the speakers relative to the listening point.

21 Claims, 5 Drawing Sheets

(56) References Cited

U.S. PATENT DOCUMENTS

| | | | | |
|---|---|---|---|---|
| 6,959,096 | B2 * | 10/2005 | Boone et al. | 381/152 |
| 2003/0118198 | A1 * | 6/2003 | Croft et al. | 381/77 |
| 2005/0276420 | A1 | 12/2005 | Davis | |
| 2006/0045295 | A1 | 3/2006 | Kim | |

OTHER PUBLICATIONS

Pulkki V: "Virtual sound source positioning using vector base amplitude panning", Journal of The Audio Engineering Society, Audio Engineering Society, New York, NY, US, vol. 45, No. 6, Jun. 1, 1996, pp. 456-466, XP000695381.

* cited by examiner

METHOD FOR CREATING AN AUDIO ENVIRONMENT HAVING N SPEAKERS

The invention relates to a method and a system for creating an audio environment. More particularly it enables to create an audio environment with N speakers fed by signals generated from the M signals originating from information encoded on a medium. The invention will more particularly be applied in the field of audiovisual and audio rooms and even more particularly in the field of private and non professional audiovisual and audio rooms of the home cinema type.

Figure 2:
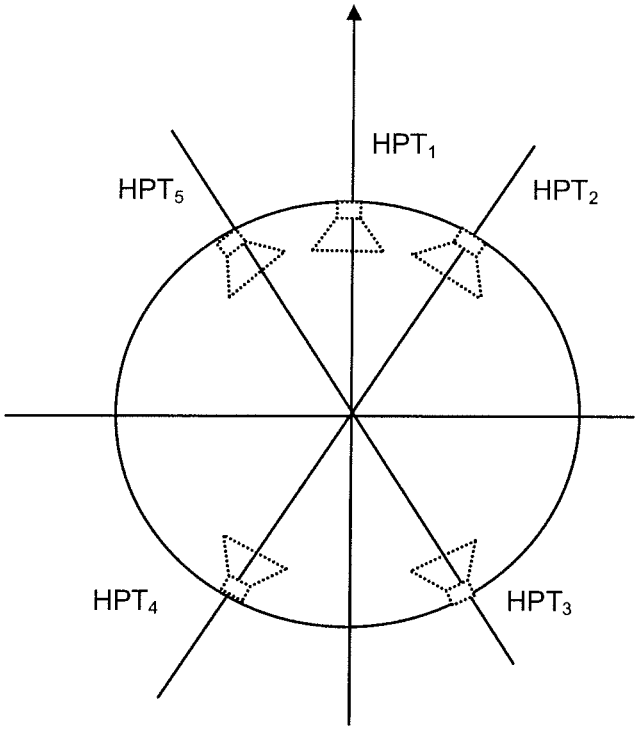

The restitution of an audio environment in a room of the home cinema type is knowingly obtained by feeding the speakers with signals containing audio information. Such signals are obtained by decoding a content stored on a medium such as a CDROM or a DVD etc. Such content results from the compression and the encoding of audio data reflecting the original sound environment to be restituted. Encoding and decoding are usually carried out using widespread technologies such as those called 5.1, 7.1 formats and other subsequent formats. Such technologies enable the creation of an audio environment distributed around a person. Such an environment is usually called a surround. Such technologies enable to respectively feed five speakers plus a subwoofer and seven speakers plus a subwoofer distributed on a circle at the centre of which the person shall be placed. A system complying with the format 5.1 recommendations is shown in FIG. 2. According to such technologies, each speaker is fed by a distinct signal through a distinct channel. These technologies are thus called multi-channel technologies.

The systems operating according to the type 5.1 or 7.1 technologies have many drawbacks. As a matter of fact, in order to obtain a satisfactory quality, the number of speakers as well as the position of each speaker as they are recommended by the encoding format should be complied with. For example, for an audio content encoded according to the 5.1 format, a sound environment restitution system must be equipped with five speakers and a subwoofer, with the five speakers having to be positioned as follows:

- in front of the person and successively positioned from left to right: a front left speaker, a central speaker, a front right speaker
- behind the person positioned from left to right: a rear left speaker, and a rear right speaker Besides, each speaker must be angularly positioned with a great accuracy, more particularly to obtain a satisfactory audio restitution.

In order to improve the restitution of an audio environment, the number of sources reflecting the environment should be increased.

Now, if two speakers positioned at different locations emit the same sound reflecting the same source in the original environment, a localisation failure occurs which results in a visible degradation of the quality of the restituted audio environment.

Solutions have been proposed which consisted in recording several audio contents encoded in different formats on the same medium. A user can thus select the decoding format which corresponds to his/her system of restitution. Such a solution generates a substantial increase in the quantity of information which must be recorded for a given environment. It thus limits the size of the content that a medium can record for a given sound environment.

In addition, solutions have been provided for increasing the number of channels while supplying each speaker with a distinct signal. However, such solutions imply, at least, the modification of the encoding format in order to record additional channels on the medium. In addition, such solutions do not make it possible to significantly increase the number of channels. Beside, such solutions require a very accurate positioning of the various speakers.

Now, such constraints concerning the positioning of the speakers turn out to be particularly prejudicial in private and non professional rooms. As a matter of fact, the configuration, the furniture and the presence of doors or windows can significantly restrict the possibility of complying with the recommendations of the conventional encoding formats.

Methods aiming at increasing or reducing the number of actual or virtual speakers were proposed then in order to modify the soundscape, but without taking into account the exact positioning of the various sound sources which gave rise to the initial surround mixing.

Methods aiming at reducing the number of speakers for a restitution on 2 channels or adding additional speakers in order to recover the exact position of the resulting virtual speakers according to the standards of the 5.1 or 7.1 formats were proposed then. Such simplified methods compute the signals of the added speakers by analysing the distance between these and the other speakers.

The aim of the invention is to restitute a surround environment in which the accuracy of localisations is improved thanks to a larger number of speakers, without the constraints imposed by the format of encoding of the audio content and thanks to a more precise computation of the signals reproduced, with the larger number of speakers being sufficient to avoid the individual detection thereof by a listening person.

For this purpose, the invention provides for a method for creating an audio environment having N speakers $HP_{i,\ i=1\ldots N}$ fed by N signals $S_{i,\ i=1\ldots N}$ carrying audio information generated from M theoretical signals $ST_{j,j=1\ldots M}$ provided to feed M theoretical speakers $HPT_{j,\ j=1\ldots M}$. The number N of speakers $HP_i$ is greater than the number M of theoretical speakers. For each speaker $HP_i$ the following steps are carried out using at least one microprocessor:

- position information is determined relating to the N speakers $HP_{i,\ i=1\ldots N}$, the M theoretical speakers $HPT_{j,j=1\ldots M}$ and a listening point,
- the two theoretical speakers $HPT_j$ and $HPT_{j+1}$ which would be angularly closest to a speaker $HP_i$, are identified
- the signal Si to be applied to each speaker $HP_{i\ is}$ computed on the basis of the positioning delay and the panning gain thereof.

More precisely, the panning gains $Gp_{ij}$ and $Gp_{i(j+1)}$, are determined on the basis of the angular distances between the theoretical speaker $HPT_j$, the theoretical speaker $HPT_{j+1}$ and the speaker HP, with respect to the listening point. They recreate the correct arrival directions of the theoretical signals $ST_j$ and $ST_{j+1}$ at the speaker $HP_i$, The balancing gains $Ge_{ij}$ and $Ge_{i(j+1)}$ enable the weighting of the theoretical signals $ST_{j,\ j=1\ldots M}$ to be re-balanced by reassigning equivalent weights to each theoretical signal $ST_{j,j=1\ldots M}$.

The positioning gain G, and delay $\tau_i$, enable the speakers $HP_{i,\ i=1\ldots N}$ to be virtually repositioned in terms of distance so that all of the sounds intended to simultaneously arrive at the listening point according to the encoding format actually arrive therein simultaneously, irrespective of the remoteness of the speakers $HP_{i,\ i=1\ldots N}$ relative to the listening point.

The signal Si is determined according to the following equation:

$$S_i=G_i[ST_j(Gp_{ij}Ge_{ij})+ST_{j+1}(Gp_{i(j+1)}Ge_{i(j+1)})]e^{-i\omega\tau_i}$$

The present invention thus provides for a method including several steps of processing which, when they are combined together, enable to recreate an audio environment with an improved quality with respect to the existing systems. This audio environment of the surround type is created with speakers the number and location of which do not depend on the audio content decoding format. A sufficiently large number of actual speakers can thus be provided such that they cannot be located individually by a human ear.

Each speaker is fed with a single signal. In addition, determining each signal $S_{i,\ i=1\ldots N}$ according to the method of the invention thus enables the correct arrival directions of the theoretical signals $ST_j$ and $ST_{j+1}$ at the speaker $HP_i$, to be recreated, the weighting of the theoretical signals $ST_{j,j=1\ldots M}$ to be re-balanced by reassigning equivalent weights to each theoretical signal $ST_j$, and the circle of theoretical positioning of the speakers, the centre of which is the listening point, to be virtually recreated.

Preferably, the least attenuated signal is determined among the signals $S_{i,\ i=1\ldots N}$, the gain which should be added to this signal to maximise it is deduced therefrom and all the signals $S_{i,\ i=1\ldots N}$ are increased by the value of the gain. This step makes it possible to optimize the global sound level.

The invention can also optionally have any one of the following characteristics:

The bisector of a first angle defined by the two theoretical speakers $HPT_j$ and $HPT_{j+1}$ and the apex of which is the listening point is identified, a data item $\phi_i$ reflecting half the first angle is determined, a data item $\theta_i$ reflecting a second angle, the apex of which is the listening point and defined, on the one hand, by the speaker $HP_i$ and on the other hand by the bisector of the first angle is also determined, and the panning gains of $Gp_{ij}$ and $Gp_{i(j+1)}$ are determined according to the following equation:

$$\frac{\tan(\theta_i)}{\tan(\varphi_i)} = \frac{Gp_{ij} - Gp_{i(j+1)}}{Gp_{ij} + Gp_{i(j+1)}} \quad C_i = Gp_{ij}^2 + Gp_{i(j+1)}^2$$

in which $C_i$ is a constant defined by the nature of the mixed signals. For instance, $C_i$ is 1. This constant may take any value above zero since it can be considered as a representation of the source volume control.

Preferably, the balancing gains $Ge_{ij}$ and $Ge_{i(j+1)}$ relating to the signal STi are computed according to the following equation:

$$Ge_{ij} = \frac{\min\left(\sum_{i=1}^{N} Gp_{i1}, \sum_{i=1}^{N} Gp_{i2}, \ldots \sum_{i=1}^{N} Gp_{iM}\right)}{\sum_{i=1}^{N} Gp_{ij}}$$

Advantageously, this computation mode makes it possible to improve the quality of the sound obtained. Besides, it enables to simplify the algorithm computing the signal $S_i$.

In an alternative solution, in order to determine the balancing gains, all the contributions of each theoreticalsignal $ST_{j,\ j=1\ldots M}$ are added up, the panning gains $Gp_{ij}$ are divided by this sum and the result is reported onto the lowest contribution. The following formula is applied:

$$Ge_{ij} = \frac{MpGp_{ij}}{\sum_{i=1}^{N} Gp_{ij}} \text{ and } Ge_{i(j+1)} = \frac{MpGp_{i(j+1)}}{\sum_{i=1}^{N} Gp_{i(j+1)}}$$

with $$Mp = \min\left(\sum_{i=1}^{N} Gp_{i1}, \sum_{i=1}^{N} Gp_{i2}, \ldots \sum_{i=1}^{N} Gp_{iM}\right)$$

$\tau_i$ is determined by carrying out the following steps: a data item $d_i$ reflecting the distance of each speaker $HP_{i,\ i=1\ldots N}$ with respect to the listening point is determined; the distance $d_{max}$ between the listening point and the $HP_i$ farthest from the listening point is determined; the delay T, according to the following equation is determined:

$$\tau_i = \frac{d_{max} - d_i}{c}$$

in which c is the speed of propagation of sound in the air.

$G_i$ is determined according to the following equation:

$$G_i = \frac{d_i}{d_{max}}$$

the number N of speakers $HP_{i,\ i=1\ldots N}$ is greater than the number M of theoretical speakers $HPT_{j,\ j=1\ldots M}$.

Advantageously, the panning gains $Gp_{ij}$ and $Gp_{i(j+1)}$ are determined, then the balancing gains $Ge_{ij}$ and $Ge_{i(j+1)}$ are determined, and then the positioning gain and delay $Gi_{and}\ \tau_i$ are determined. More particularly, this makes it possible to reduce the time and power required for the computing operations.

The object of the invention also consists of a system including at least one microprocessor arranged for implementing the above disclosed method.

The scope of the invention also provides for a computer program product including one or more sequences of instructions executable by an information processing unit, the execution of said sequences of instructions enabling the implementation of the method according to any one of the preceding characteristics.

LIST OF THE FIGURES

The appended drawings are provided as examples and are non-exhaustive depictions of the invention. They only show one embodiment of the invention and help it to be understood clearly.

Figure 1:
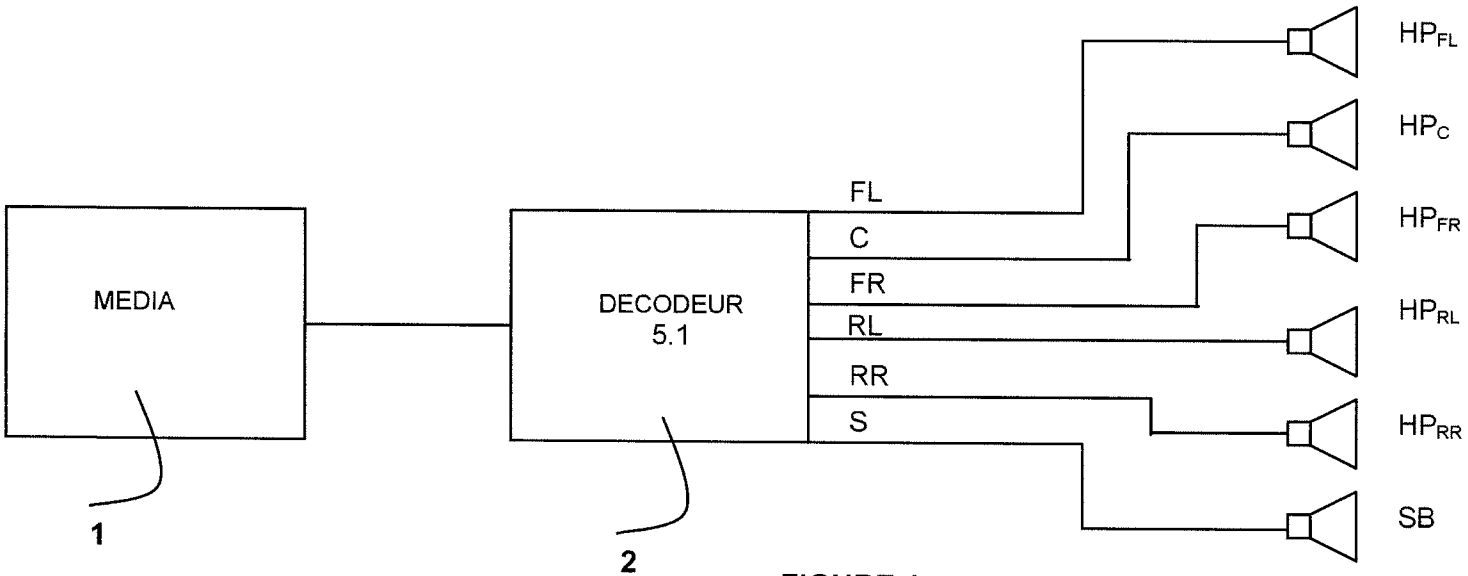
Figure 3:
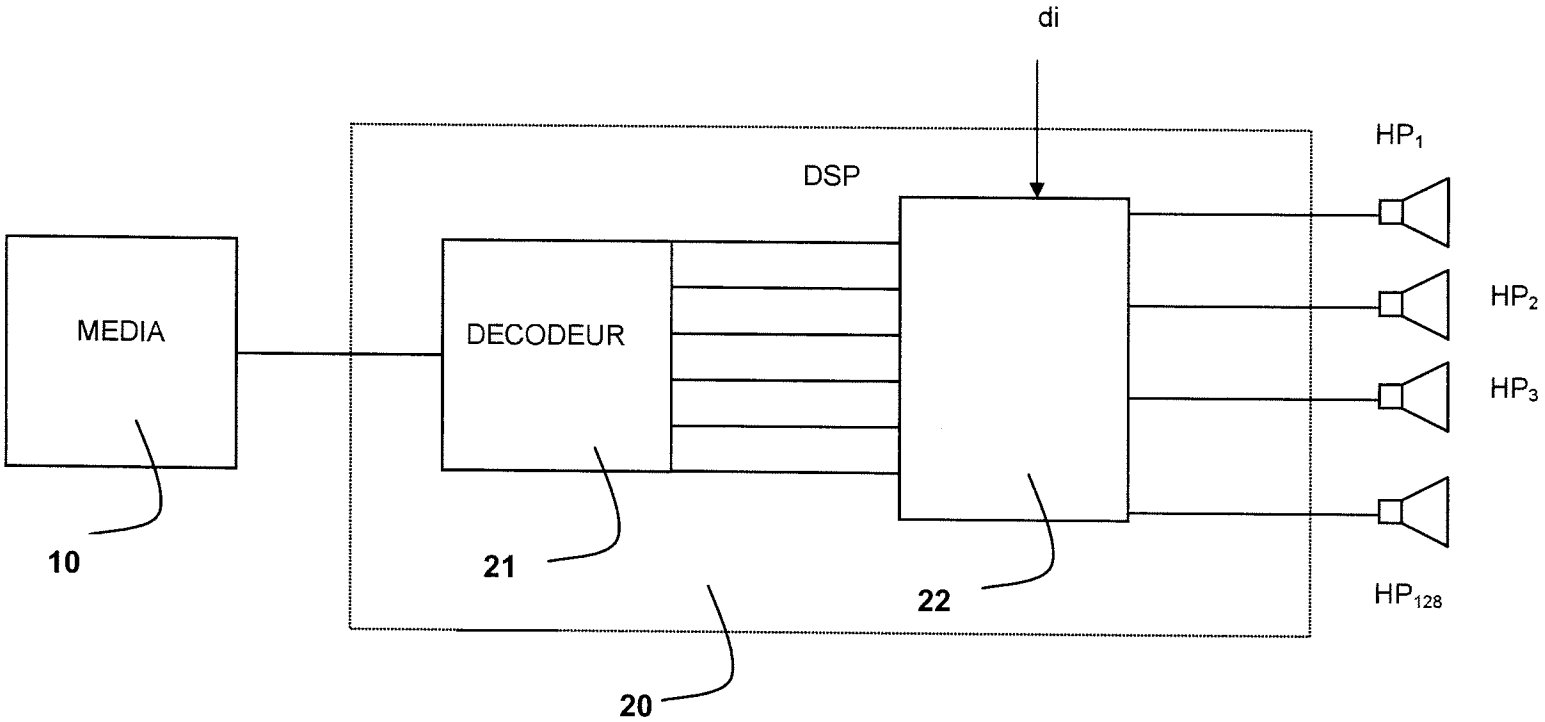
Figure 4:
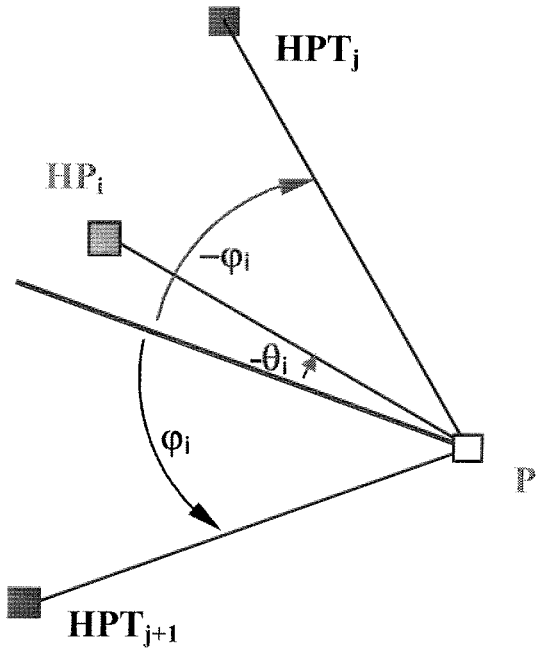

FIG. 1 is a block diagram of a known system enabling the creation of an audio environment from a content encoded according to a type 5.1. format, FIG. 2 is a simplified diagram of a known system provided on a type 5.1. installation, FIG. 3 is a block diagram of a system according to an exemplary embodiment of the invention, FIG. 4 is a diagram explaining an exemplary determination of the parameters $\phi_i$ and $\theta_i$ used in the computation of the panning gains $Gp_{ij}$ and $GP_{i(j+1)}$.

Figure 5:
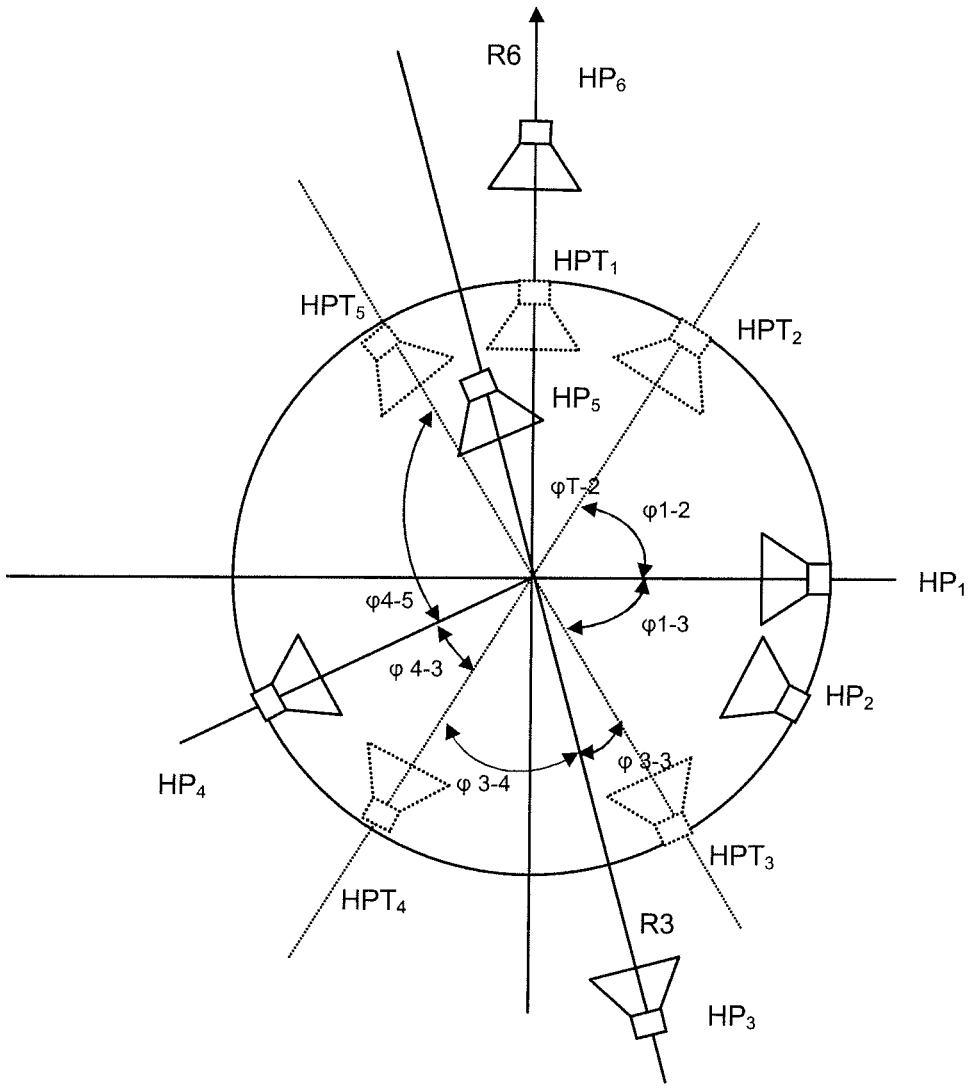

FIG. 5 is a simplified diagram of a system according to an exemplary embodiment of the invention,

DETAILED DESCRIPTION

Referring to FIG. 1, a known system enabling the creation of an audio environment from a content encoded according to a type 5.1. format, is shown.

In a system like the one shown in FIG. 1, the content recorded on a medium 1 is knowingly decoded by a decoder 2. The medium can be, for example a DVD, a CDROM, a memory, a hard disc or any other medium making it possible to store digital information.

The decoder has six channels (FL, C, FR, RL, RR, S) whereon a signal is respectively transmitted. The channels FL, C, FR, RL and RR are connected to the speakers $HP_{FL}$, $HP_C$, $HP_{FR}$, $HP_{RL}$, $HP_{RR}$ respectively. The channel S is connected to the subwoofer SB.

A known system intended for creating an audio environment from a content encoded according to format 5.1. is shown in FIG. 2. Thus the speakers $HP_C$, $HP_{FR}$, $HP_{RR}$, $HP_{RL}$ and $HP_{FL}$ are shown with references $HPT_1$, $HPT_2$, $HPT_3$, $HPT_4$, $HPT_5$ respectively The subwoofer is not shown. Each speaker is positioned according to the recommendations of format 5.1. Consequently, if the listening point or the person for whom the audio surround environment has been created is positioned at the centre of the circle C and oriented along axis X, each speaker must be positioned on the circle, according to a very precise angle.

FIG. 3 is a block diagram of an exemplary embodiment of a system according to the invention.

The system includes a digital signal processor 20, with speakers $HP_{i,\ i=1\ldots N}$ and channels connecting the digital signal processor with the speakers $HP_{i,\ i=1\ldots N}$. The digital signal processor, also called DSP, the English acronym for Digital Signal Processing, includes a decoder 21 able to decode digital data contained in a medium 10. The decoder is of a conventional type. Consequently, the invention does not require to modify the present encoding methods and remains perfectly supported by all the existing media.

The DSP also includes processing means 22 so arranged that as many distinct signals $S_{i,\ i=1\ldots N}$ are generated as there are channels connected to the speakers $HP_{i,\ i=1\ldots N}$. Processing means is specific to the invention. The DSP inputs digital data from the medium 1 and after processing, outputs the signals $S_{i,\ i=1\ldots N}$. The signals S, are generated by combining the signals decoded by the decoder from the content recorded on the medium 10. The processing means is so configured as to take into account the location of each speaker $HP_i$ to generate each signal $S_i$.

The data relative to the position of each speaker $HP_{i,\ i=1\ldots N}$ must then be determined beforehand The data is, for example, the data relative to each speaker $HP_i$ expressed in a Cartesian two- or three-dimension coordinate system in a two- or three-dimension trigonometric coordinate system. It is easily understandable that the more precisely the location of the actual speakers is estimated, the better the quality of the reproduced audio environment. Determining the coordinates of the actual speaker in a three-dimension coordinate system thus turns out to be advantageous as compared to a two-dimension coordinate system. FIG. 5 shows the diagram of a system according to the invention, wherein the positions of the speakers are identified in a two-dimension trigonometric coordinate system. Non restrictively, such determination of the positioning data can be performed upon the installation of the system, for instance after freely positioning the speakers $HP_{i,\ i=1\ldots N}$. It can be executed manually or automatically thanks to sensors placed on each speaker $HP_i$. The position of the listening point corresponding to the presumed position of the listener is also identified. Advantageously, this position coincides with the origin of the coordinate system.

Data is transmitted to the DSP. Such transmission can be executed manually using an interface such as a keyboard or automatic data acquisition means associated with the sensor.

The DSP is also provided with information relative to the encoding format. Such information is available to the DSP through a simple reading of the medium. Such information enables the DSP to determine the angular position of the theoretical speakers $HPT_{j,j=1\ldots M}$ with respect to the listening point.

As a non restrictive example, theoretical speakers are represented in dotted lines in FIG. 5 and bear reference $HPT_j$, with j=1 . . . M. In this example, the encoding/decoding format is of the 5.1 type, M is thus equal to 5. Each theoretical speaker HPT, is intended to be fed with a signal from the decoding of the information recorded on the medium and called theoretical signal $ST_{j,\ j=1\ldots M}$.

In this example in which the decoding format is of the 5.1 type, the DSP can thus define all the coordinates of the central, front right, rear right, rear left, front left theoretical speakers as well as the subwoofer, on the basis of the listening point. A theoretical circle around which the theoretical speakers $HPT_j$ should be placed to comply with the recommendations of the encoding format is determined. This circle, called a theoretical circle is determined by the DSP. The centre of this circle corresponds to the presumed location of the person for whom the surround audio environment is reproduced.

For each speaker $HP_i$ the DSP automatically identifies the two adjacent theoretical speakers $HPT_j$ and $HPT_{j+1}$. When considering the example in FIG. 5, the speakers $HP_1$ and $HP_2$ would be associated with the theoretical speakers $HPT_2$ and $HPT_3$; the speaker $HP_3$ would be associated with the theoretical speakers $HPT_3$ and $HPT_4$; the speaker $HP_4$ would be associated with the theoretical speakers $HPT_4$ and $HPT_5$, the speaker $HP_5$ would be associated with the theoretical speakers $HPT_5$ and $HPT_1$.

The DSP generates the signal $S_i$ by combining the signal $ST_j$ of each one of the theoretical speakers $HPT_j$ adjacent to the speaker $HP_i$ receiving the signal $S_i$. The proportion of each signal $ST_j$ in the signal $S_i$ depends on the relative position between the speaker $HP_i$ and the theoretical speaker $HPT_j$ associated with such theoretical signal $ST_j$. The proportion of each theoretical signal $ST_j$ is thus adjusted so that the person for whom the audio environment is created can perceive that an audio source is located at the same place as in the installation arranged according to the recommendations of the decoding format.

In another exemplary embodiment, the coordinate system is in three dimensions. The DSP then determines a sphere, preferably centred on the listening point and identifies the angular distance on this sphere between each speaker $HP_i$ and the theoretical speakers $HPT_i$.

In the following description, each channel is considered as associated with only one speaker $HP_{i,\ i=1\ldots N}$. Each speaker $HP_{i,\ i=1\ldots N}$ is then fed with a specific signal and thus delivers a specific sound. It should be noted that, in practice, several speakers $HP_i$, can be positioned on the same support such as a speaker.

The invention consists in computing, for each signal $S_{i,\ i=1\ldots N}$ several gains which correct the errors introduced by the differences in the position and the orientation between the actual speakers $HP_{i,\ i=1\ldots N}$ and the theoretical speakers $HPT_{j,\ j=1\ldots M}$ the position of which is recommended by the decoding format.

The computation of the signals $S_i$ thus depends, in addition to the theoretical signals $ST_j$ and $ST_{j+1}$, on the computation of 3 different factors:

panning gain balancing gain positioning gain and delay

The three factors above are preferably computed according to the above sequence, i.e.: the panning gain, then the balancing gain and then the positioning gain and delay.

The computation, as well as the computation sequence, of the different elements is explained in greater details as follows:

1. Panning Gain $Gp_{ij}$ and $Gp_{i(j+1)}$ are called panning gains and used for recreating the correct arrival directions of the theoretical signals $ST_j$ et $ST_{j+1}$ at the speaker $HP_i$. They are determined on the basis of the angular distances between the listening point, the speaker $HP_i$ and the theoretical speakers $HPT_j$ and $HPT_{j+1}$.

In order to determine the panning gains, the two theoretical speakers $HPT_j$ and $HPT_{j+1}$ which would be angularly closest to the straight line crossing the listening point and the actual speaker $HP_i$, and located on either side of such straight line are firstly identified. These two theoretical speakers $HPT_j$ and $HPT_{j+1}$ are thus called adjacent.

The signals $ST_j$ and $ST_{j+1}$ associated with the theoretical speakers $HPT_j$ and $HPT_{j+1}$ are mixed according to the law of tangents. For this purpose, the bisector of a first angle defined by the two theoretical speakers $HPT_j$ and $HPT_{j+1}$ and the apex of which is the listening point is identified. A data item $\phi_i$, reflecting half the first angle and a data item $\theta_i$ reflecting a second angle the apex of which is the listening point and defined, on the one hand, by the speaker $HP_i$ and on the other hand by the bisector of the first angle are determined. The diagram in FIG. 4 shows angles $\phi_i$, $\theta_i$, theoretical speakers $HPT_j$ and $HPT_{j+1}$, a listening point P and said bisector.

The panning gains $Gp_{ij}$ et $Gp_{i(j+1)}$ are then computed according to the equation:

$$\frac{\tan(\theta_i)}{\tan(\varphi_i)} = \frac{Gp_{ij} - Gp_{i(j+1)}}{Gp_{ij} + Gp_{i(j+1)}}$$

$$C_i = Gp_{ij}^2 + Gp_{i(j+1)}^2$$

in which $C_1$ is a constant. For convenience, $C_i$ is a constant equal to 1 in our application. This constant may take any value above zero since it can be considered as a representation of the source volume control.

An intermediate panning signal $Sp_i$ to be applied to the speaker $HP_i$ resulting from the mixing of the signals $ST_j$ and $ST_{j+1}$ can then be determined.

$$Sp_i = ST_j Gp_{ij} + ST_{j+1} GP_{i(j+1)}$$

2. Balancing Gain

When the panning gains are computed, the parameters $Ge_j$ and $Ge_{j+1}$, corresponding to the balancing gains are determined. These gains enable the weighting of the theoretical signals to be re-balanced by reassigning equivalent weights to each theoretical signal. This is equivalent, for example for a 5.1 system, to re-computing equivalent weighting for the 5 Centre, Front left, Front right, Surround left and Surround right signals.

To determine the balancing gains, the sum of all the contributions of each theoretical signal $ST_{j,\,j=1\ldots M}$ is inverted and reported onto the lowest contribution. The following formula is applied:

$$Ge_{ij} = \frac{\min\left(\sum_{i=1}^{N} Gp_{i1}, \sum_{i=1}^{N} Gp_{i2}, \ldots \sum_{i=1}^{N} Gp_{iM}\right)}{\sum_{i=1}^{N} Gp_{ij}}$$

An intermediate balancing signal $Se_i$ to be applied to the speaker $HP_i$ resulting from the mixing of the signals $ST_j$ and $ST_{j+1}$ can then be determined.

$$Se_i = ST_j Ge_{ij} + ST_{j+1} Ge_{i(j+1)}$$

3. Positioning Gain and Delay

The invention also provides to determine positioning gains $G_i$ and positioning delays $\tau_i$. Such gains and delays enable to virtually reposition the distance of the speakers, as provided by the decoding format. Generally, such format provides a distribution of the theoretical speakers on a circle centred on the listening point. The positioning gains and delays thus enable to virtually recreate the circle of theoretical positioning of the speakers so as to line up the speakers in terms of amplitude and phase.

There for, a data item $d_i$ reflecting the position of the speaker $HP_i$ relative to the listening point is determined. The position of the speaker $HP_i$ farthest from the listening point is thus determined. All the speakers are virtually re-positioned at equidistant intervals relative to the listening point, i.e. on a circle the radius of which corresponds to the farthest speaker.

The positioning gain $G_i$ and the positioning delay $\tau_i$ for the speaker $HP_i$ are computed as follows:

$$G_i = \frac{d_i}{d_{max}} \text{ and } \tau_i = \frac{d_{max} - d_i}{c}$$

in which c is the propagation speed of sound in the air, $d_i$ the distance between the listening point and the speaker $HP_{i,\,i=1\ldots N}$ and $d_{max}$ the distance between the listening point and the speaker closest thereto.

The positioning delay thus introduces a delay in the emission of sound at the speakers, thus enabling a time adjustment. The delay is computed while taking into account the propagation speed of sound so that the person will simultaneously receive all the signals reflecting the original audio environment and intended to be simultaneously received at a given time, at the same given time. A speaker $HP_i$ positioned at a different distance from the other speakers $HP_{i,\,i=1\ldots N}$ can thus be acoustically <<brought back>> by a time adjustment by applying a delay thereto. The signal to be sent to each speaker is first stored in the digital domain before being released and transmitted to the speaker after a time equal to the delay $\tau_i$. The delays are integrated as a number of samples, computed on the basis of the sampling frequency of the DSP.

Each speaker can be repositioned very finely. Typically, for a clock frequency of 96 kHz, the delay precision can be 10 us and for a clock frequency of 192 kHz, the delay precision can be 5 us. Such time adjustment corresponds to the repositioning of the speakers HPi within one millimeter.

More generally, $G_i$ and $\tau_i$ enable to reposition the speakers $HP_{i,\,i=1\ldots N}$ in terms of distance in order to recreate the spatial distribution of the theoretical speakers $HPT_{j,\,j=1\ldots M}$ irrespective of the distribution thereof provided by the decoding format. As a matter of fact, the usual case of a distribution of the theoretical speakers $HPT_{j,\,j=1\ldots M}$ according to a circle centred on the listening point was considered beforehand. $G_i$ and $\tau_i$ may also enable to reposition the actual speakers, should the theoretical speakers $HPT_{j,\ j=1\ldots M}$ not be intended to be distributed on a circle centred on the listening point.

When the 3 factors are computed, the signal $S_i$ intended to be fed to the speaker $HP_i$. can be computed. $S_i$ is then written according to the following equation:

$$S_i=G_i[ST_j(Gp_{ij}Ge_{ij})+ST_{j+1}(Gp_{i(j+1)}Ge_{i(j+1)})]e^{-i\omega\tau_i}$$

The invention thus makes it possible to supply each speaker with a signal $S_i$ so determined as to correct several types of errors, irrespective of the position deviations between the theoretical speakers $HPT_j$ and $HPT_{j+1}$ and the actual speakers $HP_{i,\ i=1\ldots N}$. As a matter of fact the signal Si enables the correct arrival directions of the theoretical signals to be recreated, the theoretical signals to be re-balanced by reassigning equivalent weights to each theoretical signal $ST_j$ and to reposition the speakers in terms of distance as recommended by the encoding/decoding format.

The DSP can also carry out a non compulsory additional step of scaling. This step aims at obtaining a maximum signal level. As each signal $S_i$ is computed on the basis of three different gains, all speakers will probably be attenuated in the end. The step of scaling is then used for increasing all speakers by the value of the gain of the least attenuated speaker. Eventually, the latter will have a unit gain. This step makes it possible to optimize the global sound level. It is particularly advantageous, but remains optional within the scope of the invention.

In practice, the DSP attenuates the original signals of each theoretical speaker adjacent to a given speaker HP, and adds up these. The DSP can generate a very large number of signals by remixing the theoretical signals $ST_j$ resulting from the decoding. FIG. 3 thus shows a system with 128 channels respectively connected to one of the speakers $HP_1$ to $HP_{128}$. The invention thus enables to significantly increase the number of channels as compared to the existing systems which generally have six or eight channels, by distributing the total power of the system over a much larger number of speakers. It enables to equip a room with less powerful speakers, i.e. of a much higher quality than the speakers used in the known systems while maintaining an identical power for the whole system.

Besides, the invention makes the inconvenience of a speaker failure less prejudicial since the detection thereof is not very significant as regards the audio environment created by the other speakers. As a matter of fact, detecting a failing speaker is almost impossible in an installation equipped with a large number of speakers.

In addition, the quality of the audio environment is free of interferences relating to "location errors" since each speaker $HP_i$ is fed by a specific signal. Then the same sound is reproduced at only one location.

The invention makes it possible to freely position each speaker, while taking into account the constraints relative to the dimensions, decoration and furniture of a room.

The DSP is also so arranged as to provide a perfect synchronisation between the various signals $S_i$.

The signal processing executed by the DSP thus enables to supply a signal $S_i$ mixed so that the person can think that the audio source reproduced by the speaker $HP_i$ comes from the same place as the audio source which would have been reproduced by the theoretical speakers $HPT_j$ and $HPT_{j+1}$ adjacent to the speaker $HP_i$. Similarly, the signals $S_i$ and $S_{i+1}$ from the adjacent speakers $HP_i$ et $HP_{i+1}$ enable to reset a virtual speaker positioned at the same place as a theoretical speaker $HP_j$ complying with the recommendations of the encoding format.

In addition, the system makes it possible to take into account each speaker $HP_j$ own parameters. Such parameters more particularly include the filter built-in in each speaker $HP_i$ usually called <<built-in crossover>> or <<crossover>>. The filter affects the time-adjustment as well as the mixing of each signal $S_i$ from the theoretical signals $ST_j$ resulting from the decoding.

A speaker often has several channels, restitution means and amplification means which respectively enable to divide the received signal into several frequency ranges respectively corresponding to one of said channels and to amplify the signals resulting from the filtration and feeding each channel. Each channel is so arranged as to precisely restitute a sound corresponding to one of the frequency ranges.

The invention enables to time-adjust the signals by applying a delay to such restitution means and/or amplification means. Besides, it makes it possible to apply an additional crossover-induced "group delay" and to take into account such additional delay to "acoustically reposition" each speaker $HP_i$ on the surround circle in order to time-adjust each speaker $HP_i$. The computation of such correction was the subject of an article by the AES (Ville Pulkki, "Virtual Sound Source Positioning Using Vector Base Amplitude Panning" JAES, Vol. 45, No.6, 1997 Juin.

Then the invention enables to increase the number of channels and to generate signals taking into account the accurate position of the speakers associated with these channels by cancelling the constraints concerning the dimension and the decoration of the room where the audio environment is reproduced.

The invention thus makes it possible to restitute a surround environment where the accuracy of the locations is improved by a larger number of speakers without the constraints on the position and the number of speakers as imposed by the encoding format of the audio content. The number of actual speakers can be sufficient to avoid their being detected individually.

The present invention is not limited to the above described embodiments but applies to any embodiment complying with its spirit.

REFERENCES

1. Medium
2. Decoder
20. Digital signal processor DSP
21. Decoder
22. Processing means

The invention claimed is:

1. A method for creating an audio environment having N speakers $HP_{i,\ i=1\ldots N}$ fed by N signals $S_{i,\ i=1\ldots N}$ generated from M theoretical signals $ST_{j,\ j=1\ldots M}$ provided to feed M theoretical speakers $HPT_{j,\ j=1\ldots M}$, wherein:

position information is determined relating to the N speakers $HP_{i,\ i=1\ldots N}$ and a listening point, the two theoretical speakers $HPT_j$ and $HPT_{j+1}$ which would be angularly closest to a speaker $HP_i$, are identified the signal $S_i$ is determined according to the following equation:

$$S_i=G_i[ST_j(Gp_{ij}Ge_{ij})+ST_{j+1}(Gp_{i(j+1)}Ge_{i(j+1)})]e^{-i\omega\tau_i}$$

in which:

$Gp_{ij}$ and $Gp_{i(j+1)}$ are panning gains determined on the basis of the angular distances between the theoretical speaker $HPT_j$ and the theoretical speaker $HPT_{j+1}$, and the speaker HPi with respect to the listening point and which recreate the correct arrival directions of the theoretical signals $ST_j$ and $ST_{j+1}$ at the speaker $HP_i$, $Ge_{ij}$ and $Ge_{i(j+1)}$ are balancing gains enabling the weighting of the theoretical signals $ST_{j,\ j=1\ldots M}$ to be re-balanced by reassigning equivalent weights to each theoretical signal $ST_{j,\ j=1\ldots M}$, $G_i$ and $\tau_i$ are a positioning gain and delay, respectively, which enable the speakers $HP_{i,\ i=1\ldots N}$ to be virtually repositioned in terms of distance so that all of the sounds intended to simultaneously arrive at the listening point according to the encoding format actually arrive therein simultaneously, irrespective of the remoteness of the speakers $HP_{i,\ i=1\ldots N}$ relative to the listening point.

2. A method according to claim 1, wherein the bisector of a first angle defined by the two theoretical speakers $HPT_j$ and $HPT_{j+1}$ and the apex of which is the listening point, is identified, a data item $_i$ reflecting half the first angle is determined, a data item $_i$ reflecting a second angle, the apex of which is the listening point and defined, on the one hand, by the speaker $HP_i$ and on the other hand by the bisector of the first angle is also determined, and the panning gains of $Gp_{ij}$ and $Gp_{i(j+1)}$ are determined according to the following equation:

$$\frac{\tan(\theta_i)}{\tan(\varphi_i)} = \frac{Gp_{ij} - Gp_{i(j+1)}}{Gp_{ij} + Gp_{i(j+1)}}$$

$$C_i = Gp_{ij}^2 + Gp_{i(j+1)}^2$$

in which $C_i$ is a constant representing the sound volume of the source.

3. A method according to claim 1, wherein the panning gains $Gp_{ij}$ and $Gp_{i(j+1)}$ are determined, then the balancing gains $Ge_{ij}$ and $Ge_{i(j+1)}$ are determined, and then the positioning gain and delay $G_i$ and $_i$ are determined.

4. A method according to claim 1, wherein the balancing gains $Ge_{ij}$ and $Ge_{i(j+1)}$ are determined according to the following equations:

$$Ge_{ij} = \frac{\min\left(\sum_{i=1}^{N} Gp_{i1}, \sum_{i=1}^{N} Gp_{i2}, \ldots \sum_{i=1}^{N} Gp_{iM}\right)}{\sum_{i=1}^{N} Gp_{ij}}$$

$$Ge_{i(j+1)} = \frac{\min\left(\sum_{i=1}^{N} Gp_{i1}, \sum_{i=1}^{N} Gp_{i2}, \ldots \sum_{i=1}^{N} Gp_{iM}\right)}{\sum_{i=1}^{N} Gp_{i(j+1)}}.$$

5. A method according to claim 1, wherein the balancing gains $Ge_{ij}$ and $Ge_{i(j+1)}$ are determined according to the following equation:

$$Ge_{ij} = \frac{MpGp_{ij}}{\sum_{i=1}^{N} Gp_{ij}}$$

and $$Ge_{i(j+1)} = \frac{MpGp_{i(j+1)}}{\sum_{i=1}^{N} Gp_{i(j+1)}}$$

-continued with $$Mp = \min\left(\sum_{i=1}^{N} Gp_{i1}, \sum_{i=1}^{N} Gp_{i2}, \ldots \sum_{i=1}^{N} Gp_{iM}\right).$$

6. A method according to claim 1, wherein $_i$ is determined by carrying out the following steps:

A data item $d_i$ reflecting the distance between each speaker $HP_{i,\ i=1\ldots N}$ and the listening point is determined, the distance $d_{max}$ between the listening point and the speaker $HP_i$ farthest from the listening point is determined, The delay $_i$ is determined according to the following equation:

$$\tau_i = \frac{d_{max} - d_i}{c}$$

in which c is the propagation speed of sound in the air.

7. A method according to claim 6, wherein $G_i$ is determined according to the following equation:

$$G_i = \frac{d_i}{d_{max}}.$$

8. A method according to claim 1, wherein among the signals $S_{i,\ i=1\ldots N}$ the least attenuated signal is determined, the global gain of this least attenuated signal is determined and all the signals $S_{i,\ i=1\ldots N}$ are increased by the value of this global gain.

9. A method according to claim 1, wherein the number N of speakers $HP_{i,\ i=1\ldots N}$ is greater than the number M of theoretical speakers $HPT_{j,\ j=1\ldots M}$.

10. Computer program product recorded on a non transient medium and including one or more sequences of instructions executable by an information processing unit, the execution of said sequences of instructions enabling the implementation of the method according to claim 1.

11. A system for creating an audio environment having N speakers $HP_{i,\ i=1\ldots N}$ fed by N signals $S_{i,\ i=1\ldots N}$ generated from M theoretical signals $ST_{j,\ j=1\ldots M}$ provided to feed M theoretical speakers $HPT_{j,\ j=1\ldots M}$, characterized in that it includes at least a processor so arranged as to perform the following steps:

obtaining position information relating to the N speakers $HP_{i,\ i=1\ldots N}$ and a listening point, identifying the two theoretical speakers $HPT_j$ and $HPT_{j+1}$ which would be angularly closest to a speaker $HP_i$, determining the signal $S_i$ according to the following equation:

$$S_i = G_i[ST_j(Gp_{ij}Ge_{ij}) + ST_{j+1}(Gp_{i(j+1)}Ge_{i(j+1)})]e^{-i\omega\tau_i}$$

in which:

$Gp_{ij}$ and $Gp_{i(j+1)}$ are panning gains determined on the basis of the angular distances between the listening point, the speaker $HP_i$ and the theoretical speakers $HPT_j$ and $HPT_{j+1}$, and which recreate the correct arrival directions of the theoretical signals $ST_j$ and $ST_{j+1}$ at the speaker $HP_i$, $Ge_{ij}$ and $Ge_{i(j+1)}$ are balancing gains enabling the weighting of the theoretical signals $ST_{j,\ j=1\ldots M}$ to be re-balanced by reassigning equivalent weights to each theoretical signal $ST_{j,\ j=1\ldots M}$, $G_i$ and $_i$ are a positioning gain and positioning delay, respectively, which enable the speakers $HP_{i,\ i=1\ldots N}$ to be virtually repositioned in terms of distance so that all of the sounds intended to simultaneously arrive at the listening point according to the encoding format actually arrive therein simultaneously, irrespective of the remoteness of the speakers $HP_{i,\ i=1\ldots N}$ relative to the listening point.

12. A method according to claim 2, wherein the balancing gains $Ge_{ij}$ and $Ge_{i(j+1)}$ are determined according to the following equations:

$$Ge_{ij} = \frac{\min\left(\sum_{i=1}^{N} Gp_{i1}, \sum_{i=1}^{N} Gp_{i2}, \ldots \sum_{i=1}^{N} Gp_{iM}\right)}{\sum_{i=1}^{N} Gp_{ij}}$$

$$Ge_{i(j+1)} = \frac{\min\left(\sum_{i=1}^{N} Gp_{i1}, \sum_{i=1}^{N} Gp_{i2}, \ldots \sum_{i=1}^{N} Gp_{iM}\right)}{\sum_{i=1}^{N} Gp_{i(j+1)}}.$$

13. A method according to claim 2, wherein the balancing gains $Ge_{ij}$ and $Ge_{i(j+1)}$ are determined according to the following equation:

$$Ge_{ij} = \frac{MpGp_{ij}}{\sum_{i=1}^{N} Gp_{ij}}$$

and $$Ge_{i(j+1)} = \frac{MpGp_{i(j+1)}}{\sum_{i=1}^{N} Gp_{i(j+1)}}$$

with $$Mp = \min\left(\sum_{i=1}^{N} Gp_{i1}, \sum_{i=1}^{N} Gp_{i2}, \ldots \sum_{i=1}^{N} Gp_{iM}\right).$$

14. A method according to claim 2, wherein $_i$ is determined by carrying out the following steps:

A data item $d_i$ reflecting the distance between each speaker $HP_{i,\ i=1\ldots N}$ and the listening point is determined, the distance $d_{max}$ between the listening point and the speaker $HP_i$ farthest from the listening point is determined, The delay $_i$ is determined according to the following equation:

$$\tau_i = \frac{d_{max} - d_i}{c}$$

in which c is the propagation speed of sound in the air.

15. A method according to claim 2, wherein among the signals $S_{i,\ i=1\ldots N}$ the least attenuated signal is determined, the global gain of this least attenuated signal is determined and all the signals $S_{i,\ i=1\ldots N}$ are increased by the value of this global gain.

16. A method according to claim 2, wherein the number N of speakers $HP_{i,\ i=1\ldots N}$ is greater than the number M of theoretical speakers $HPT_{j,\ j=1\ldots M}$.

17. A method according to claim 3, wherein the balancing gains $Ge_{ij}$ and $Ge_{i(j+1)}$ are determined according to the following equations:

$$Ge_{ij} = \frac{\min\left(\sum_{i=1}^{N} Gp_{i1}, \sum_{i=1}^{N} Gp_{i2}, \ldots \sum_{i=1}^{N} Gp_{iM}\right)}{\sum_{i=1}^{N} Gp_{ij}}$$

$$Ge_{i(j+1)} = \frac{\min\left(\sum_{i=1}^{N} Gp_{i1}, \sum_{i=1}^{N} Gp_{i2}, \ldots \sum_{i=1}^{N} Gp_{iM}\right)}{\sum_{i=1}^{N} Gp_{i(j+1)}}.$$

18. A method according to claim 3, wherein the balancing gains $Ge_{ij}$ and $Ge_{i(j+1)}$ are determined according to the following equation:

$$Ge_{ij} = \frac{MpGp_{ij}}{\sum_{i=1}^{N} Gp_{ij}}$$

and $$Ge_{i(j+1)} = \frac{MpGp_{i(j+1)}}{\sum_{i=1}^{N} Gp_{i(j+1)}}$$

with $$Mp = \min\left(\sum_{i=1}^{N} Gp_{i1}, \sum_{i=1}^{N} Gp_{i2}, \ldots \sum_{i=1}^{N} Gp_{iM}\right).$$

19. A method according to claim 3, wherein $_i$ is determined by carrying out the following steps:

A data item $d_i$ reflecting the distance between each speaker $HP_{i,\ i=1\ldots N}$ and the listening point is determined, the distance $d_{max}$ between the listening point and the speaker $HP_i$ farthest from the listening point is determined, The delay $_i$ is determined according to the following equation:

$$\tau_i = \frac{d_{max} - d_i}{c}$$

in which c is the propagation speed of sound in the air.

20. A method according to claim 3, wherein among the signals $S_{i,\ i=1\ldots N}$ the least attenuated signal is determined, the global gain of this least attenuated signal is determined and all the signals $S_{i,\ i=1\ldots N}$ are increased by the value of this global gain.

21. A method according to claim 3, wherein the number N of speakers $HP_{i,\ i=1\ldots N}$ is greater than the number M of theoretical speakers $HPT_{j,\ j=1\ldots M}$.

* * * * *